US007171967B2

(12) United States Patent
Brunell et al.

(10) Patent No.: US 7,171,967 B2
(45) **Date of Patent: *Feb. 6, 2007**

(54) FACE MASK AND METHOD OF MANUFACTURING THE SAME

(75) Inventors: Robert A. Brunell, Forestdale, MA (US); George A. Snow, Middleboro, MA (US)

(73) Assignee: Louis M. Gerson Co., Inc., Middleboro, MA (US)

( * ) Notice: Subject to any disclaimer, the term of this patent is extended or adjusted under 35 U.S.C. 154(b) by 520 days.

This patent is subject to a terminal disclaimer.

(21) Appl. No.: 10/423,382

(22) Filed: Apr. 25, 2003

(65) Prior Publication Data

US 2003/0226563 A1 Dec. 11, 2003

Related U.S. Application Data

(60) Provisional application No. 60/386,297, filed on Jun. 5, 2002.

(51) Int. Cl.
*A62B 7/10* (2006.01)
*A62B 18/02* (2006.01)

(52) U.S. Cl. ..... 128/206.19; 128/205.25

(58) Field of Classification Search ..... 128/205.25, 128/205.27, 205.29, 206.12, 206.15, 206.16, 128/206.18, 206.19, 206.21, 206.28, 207.12, 128/207.13

See application file for complete search history.

(56) References Cited

U.S. PATENT DOCUMENTS

| | | | | |
|---|---|---|---|---|
| 1,523,884 | A * | 1/1925 | LeDuc | 128/863 |
| 3,500,825 | A * | 3/1970 | Andersson et al. | 128/863 |
| 3,664,335 | A * | 5/1972 | Boucher et al. | 128/206.19 |
| 3,971,369 | A * | 7/1976 | Aspelin et al. | 128/206.19 |
| D249,072 | S | 8/1978 | Revoir | D29/8 |
| 4,133,309 | A | 1/1979 | Kohler et al. | 128/146.6 |
| 4,215,682 | A | 8/1980 | Kubik et al. | 128/205.29 |
| 4,245,220 | A | 1/1981 | Johnson | 343/16 R |
| 4,417,575 | A | 11/1983 | Hilton et al. | 128/206.19 |
| 4,419,994 | A | 12/1983 | Hilton | 128/206.19 |
| 4,536,440 | A | 8/1985 | Berg | 428/284 |
| 4,547,420 | A | 10/1985 | Krueger et al. | 428/229 |
| 4,628,927 | A * | 12/1986 | Ward | 128/206.17 |
| 4,827,924 | A | 5/1989 | Japuntich | 428/206.12 |
| 4,874,339 | A | 10/1989 | Bratz | 445/28 |
| 5,025,506 | A | 6/1991 | Huang | 2/206 |
| 5,232,529 | A | 8/1993 | Miyake | 156/73.4 |
| 5,325,892 | A | 7/1994 | Japuntich et al. | 137/855 |
| 5,357,947 | A * | 10/1994 | Adler | 128/201.13 |

(Continued)

FOREIGN PATENT DOCUMENTS

| | | |
|---|---|---|
| DE | 32 04322 A1 | 8/1983 |

(Continued)

*Primary Examiner*—Teena Mitchell
(74) *Attorney, Agent, or Firm*—Bromberg & Sunstein LLP

(57) ABSTRACT

A mask includes a filter layer and a support base supporting the filter layer. The filter layer has first and second complimentary portions that together form a rim, where the first portion is connected to the second portion at first and second seams. The first seam extends from the rim to a first pleat, while the second seam extends from the rim to a second pleat. The first pleat is connected to the second pleat by an unpleated central portion. The first pleat, second pleat and unpleated central portion are formed by the first and second portions of the filter layer.

14 Claims, 6 Drawing Sheets

U.S. PATENT DOCUMENTS

| | | | | |
|---|---|---|---|---|
| 5,927,280 | A | 7/1999 | Miyake | 128/857 |
| 5,954,055 | A | 9/1999 | Miyake | 128/857 |
| 6,123,077 | A * | 9/2000 | Bostock et al. | 128/206.12 |
| 6,145,504 | A | 11/2000 | Miyake | 128/206.19 |
| 6,336,459 | B1 | 1/2002 | Miyake et al. | 128/857 |
| RE37,974 | E * | 2/2003 | Bowers | 137/855 |

FOREIGN PATENT DOCUMENTS

| | | |
|---|---|---|
| EP | 1 118 278 A2 | 7/2001 |
| GB | 2 045 093 A | 10/1980 |

* cited by examiner

FACE MASK AND METHOD OF MANUFACTURING THE SAME

PRIORITY

This patent application claims priority from provisional U.S. patent application No. 60/386,297, filed Jun. 5, 2002, and naming Robert A. Brunell and George A. Snow as inventors, the disclosure of which is incorporated herein, in its entirety, by reference.

FIELD OF THE INVENTION

The invention relates generally to face masks and, more particularly, the invention relates to face masks used to filter air breathed by people wearing such face masks.

BACKGROUND OF THE INVENTION

Air filtration masks (referred to herein as "filter masks") are widely used to protect people from air borne contaminants and gasses. For example, air borne dust particles are a known hazard commonly on work sites. Consequently, such workers normally wear filter masks to avoid inhaling the dust particles. To that end, filter masks used in this application are manufactured with a filter material specified to prevent, among other things, a substantial majority of dust particles from being inhaled by the worker.

In addition to primarily protecting inhaled air, some filter masks are specifically manufactured to filter both inhaled and exhaled air. For example, hospital staff often wear filter masks to prevent both their germs from infecting patients, and patients' germs from infecting them.

There is a need in the art to improve the filtration efficiency of filter masks. Accordingly, filter masks with multiple filter layers have been developed for that purpose. Multiple filter layer filter masks typically filter particles and gasses more efficiently than many types of single filter layer filter masks. Use of multiple filter layers, however, undesirably increases the air resistance through the filter mask. Consequently, a person wearing the filter mask-may have a more difficult time breathing. In fact, due to reduced amount of breathable air, some people can become dizzy when wearing multiple layer filter masks.

To overcome this problem while still providing improved filtration efficiency, filter masks have been developed to increase filter area, thus improving performance. Manufacture of such filter masks, however, can be more complex than filter masks with multiple filter layers. Sometimes, increasing the area can cause portions of the single layer filter layer to overlap. Overlap effectively increases the thickness of the filter layer, thus causing the same air resistance problem as discussed above.

SUMMARY OF THE INVENTION

In accordance with one aspect of the invention, a method of manufacturing a mask folds a sheet of filter material into a set of sections that each has two ends. The two ends of each of the sections then are reshaped to form two reshape lines common to all of the set of sections. The sections then are connected along the two reshape lines to form a primary assembly. Note that the two reshape lines are not connected together. The primary assembly is folded inside-out to form a secondary assembly, and then coupled to a support base. The set of sections illustratively includes at least four sections.

In some embodiments, each of the set of sections includes a first side and a second side, where the first side and the second side of each section are the two ends noted above. The two ends of each of the sections thus are reshaped by making first and second cuts along the folded sheet of filter material. The first cut cuts the first side of each section, while the second cut cuts the second side of each section. In other embodiments, the set of sections may be connected along the two reshape lines by a number of ways known in the art, such as by at least one of bonding, welding, sewing, gluing, fastening, and heating along either of the two reshape lines.

The primary assembly may have the form of a trapezoid, and may be substantially flat. In addition, the set of sections may be formed to include two end sections and two middle sections, where the middle sections are between the two end sections. Each of the two middle sections illustratively has a smaller area than the area of either of the two end sections.

The secondary assembly may include a rim forming an opening. The secondary assembly thus may be coupled to the support base by bonding the rim to the support base. In yet other embodiments, the secondary assembly forms a concave portion, and the support base has a corresponding convex portion. To couple the secondary assembly, the convex portion may be placed into the concave portion before coupling the secondary assembly to the support base. The secondary assembly further may include at least one pleat.

In accordance with another aspect of the invention, a mask includes a filter layer and a support base supporting the filter layer. The filter layer has first and second complimentary portions that together form a rim, where the first portion is connected to the second portion at first and second seams. The first seam extends from the rim to a first pleat, while the second seam extends from the rim to a second pleat. The first pleat is connected to the second pleat by an unpleated central portion. The first pleat, second pleat and unpleated central portion are formed by the first and second portions of the filter layer.

In some embodiments, the filter layer has an effective center line that bisects the filter layer in a longitudinal direction. The first and second seams are substantially coincident with the effective center line. Moreover, the first and second pleats may be substantially bisected by the effective center line. The filter layer may form a concave inner surface, and the support base may form a convex outer surface. The concave inner surface of the filter layer may face the convex outer surface of the support base, and the concave inner surface of the filter layer may be free to move relative to the convex outer surface of the support base.

The filter layer may form a filter rim and the support base may form a base rim. Consequently, the filter rim may be secured to the base rim for form the rim. The filter layer illustratively is normally substantially free of overlap. The mask also may include a valve extending through both the filter layer and the support base. Porous polyester is one exemplary material used for the support base, while the filter layer may be manufactured from polypropylene. The surface area of the filter layer illustratively is greater than the surface area of the support base. The filter layer normally forms an opening.

BRIEF DESCRIPTION OF THE DRAWINGS

The foregoing and advantages of the invention will be appreciated more fully from the following further description thereof with reference to the accompanying drawings wherein.

DESCRIPTION OF ILLUSTRATIVE EMBODIMENTS

In illustrative embodiments of the invention, an air filtration mask (hereinafter "filter mask 10" or "mask 10") is constructed to have an increased filtration area by incorporating two pleats into its filter layer. Moreover, manufacturing is simplified because, among other things, much of the process of manufacturing the filter layer may be completed while such filter layer is laid flat. Details of illustrative embodiments are discussed below.

Figure 1:
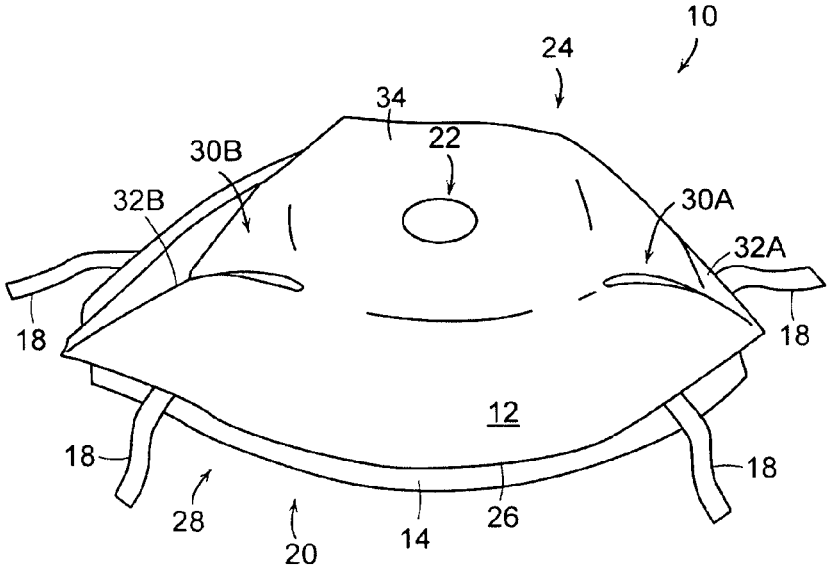
FIG. 1 schematically shows an exemplary filter mask constructed in accordance with illustrative embodiments of the invention.

FIG. 1 schematically shows an exemplary filter mask 10 constructed in accordance with illustrative embodiments of the invention. Specifically, the filter mask 10 includes a specially constructed filter layer 12 that is supported on a porous, but relatively more rigid, molded support base 14. In illustrative embodiments, the filter layer 12 and support base 14 are sufficiently resilient so that the filter mask 10 has a normally open concave area for sealingly receiving a user's nose and mouth (see FIG. 2).

Figure 2:
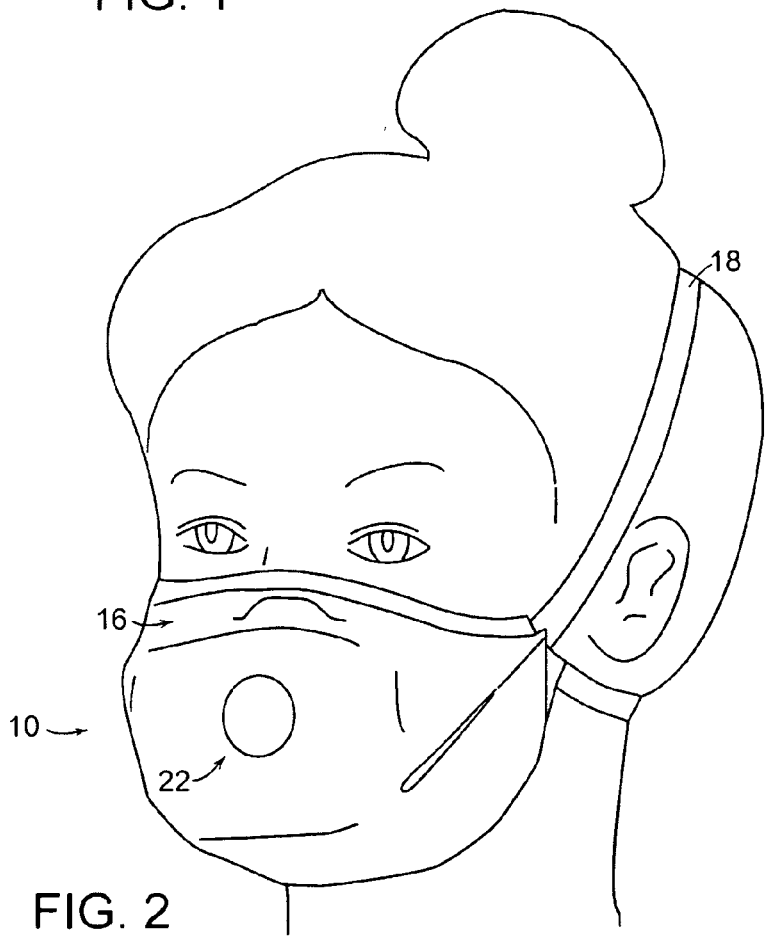
FIG. 2 schematically shows a person wearing the mask shown in FIG. 1.

The filter mask 10 shown in FIGS. 1 and 2 also includes a nose piece 16 to properly position the mask 10 against the user's nose, straps 18 to secure the mask 10 to the user's face, and a peripheral rim 20 that contours to the user's face when worn. The filter mask 10 also includes a one-way valve 22 that more freely permits air to be exhaled. Of course, illustrative embodiments permit air to be freely inhaled through the filter layer 12 and support base 14. The valve 22 may be any valve known in the art conventionally used for these purposes, such as a one-way flapper valve.

The straps 18 may be constructed from a resilient rubber material, or other conventionally known material (e.g., a non-resilient fabric), that permits a secure and snug fit between the user's face and the rim 20. The straps 18 thus apply an inwardly directed force for those purposes. At a minimum, this force should be sufficient at least to hold the mask 10 to the user's face. Moreover, it is preferred that the rim 20 have a contoured surface that contours to the user's face. Accordingly, when the straps 18 apply the noted inwardly directed force to the mask 10, the contoured surface should be sufficiently flexible and resilient to shape to the user's face. This ensures that the substantial majority of the user's air is inhaled and exhaled through the filter mask 10. In some embodiments, the rim 20 includes additional material (e.g., rubber) to provide an effective seal against the user's face.

In accordance with illustrative embodiments, the filter layer 12 is constructed to have complimentary top and bottom portions 24 and 26 that together form both 1) a filter layer rim 28, and 2) a pair of pleats 30A and 30B. As known by those in the art, pleats are formed by a portion of the filter material that is normally folded. Although the pleats may be single pleats (one fold), illustrative embodiments include double pleats (two folds). The pleats 30A and 30B desirably increase the surface area of the filter layer 12, consequently improving filtering efficiency without requiring multiple filter layers or heavier single layers. In illustrative embodiments, other than portions of the pleats 30A and 30B, the entire filter layer 12 is substantially free of overlap. In other words, portions of the filter layer 12 do not overlap other portions. As known by those skilled in the art, being substantially free of overlap is beneficial because they typically increase air resistance through the filter mask 10. Details of the manufacturing process that forms the pleats 30A and 30B are discussed below with reference to FIG. 3.

The complimentary top and bottom portions 24 and 26 of the filter layer 12 illustratively are mirror images of each other. Accordingly, the top portion 24 and bottom portion 26 are considered to meet along an effective center line 35 (see FIG. 7)that bisects the entire filter layer 12. This effective center line 35 also is substantially coincident with a pair of seams 32A and 32B that each extend from the filter layer rim 28 to one of the pleats 30A and 30B. The pleats 30A and 30B are bridged via an unpleated central portion 34 of the filter layer 12 that also is bisected by the effective center line 35. In a similar manner, the effective center line 35 also bisects both pleats 30A and 30B. In practice, however, it is expected that manufacturing tolerances may not permit every filter mask 10 to have exactly bisected/coincident filter layer portions. Those filter masks having filter layer portions that are not exactly bisected/coincident, but very close to being bisected/coincident, also should be considered to be within the scope of various embodiments of the invention.

Figure 3:
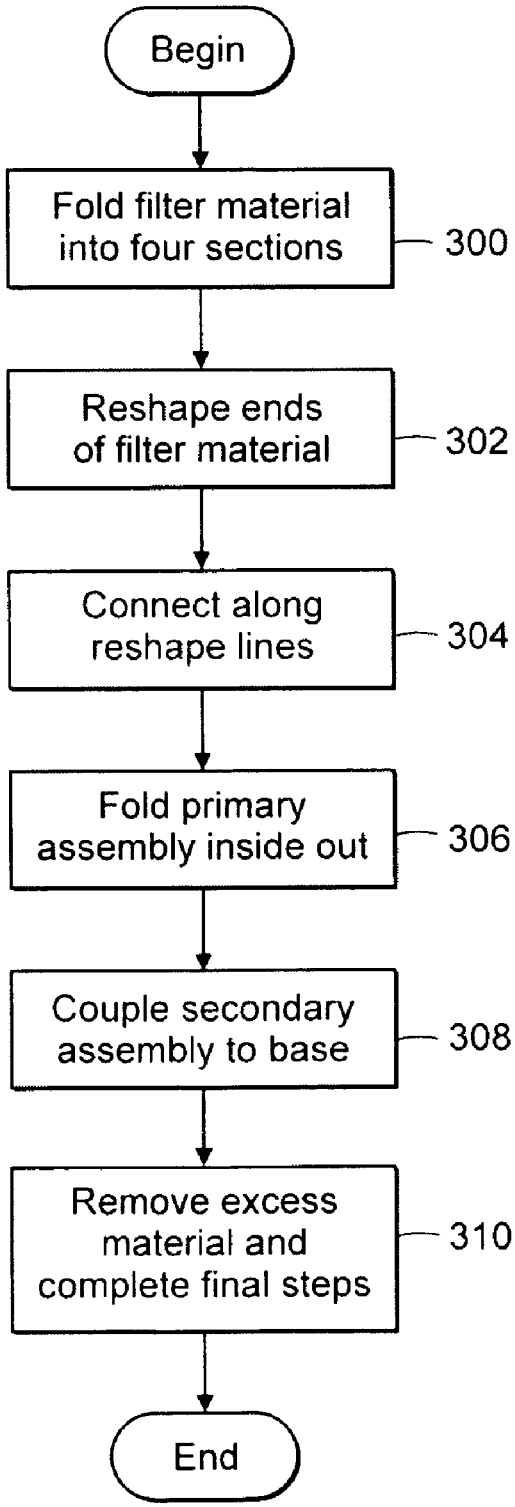
FIG. 3 shows a process of manufacturing the mask shown in FIG. 1 in accordance with illustrative embodiments of the invention.
Figure 4:
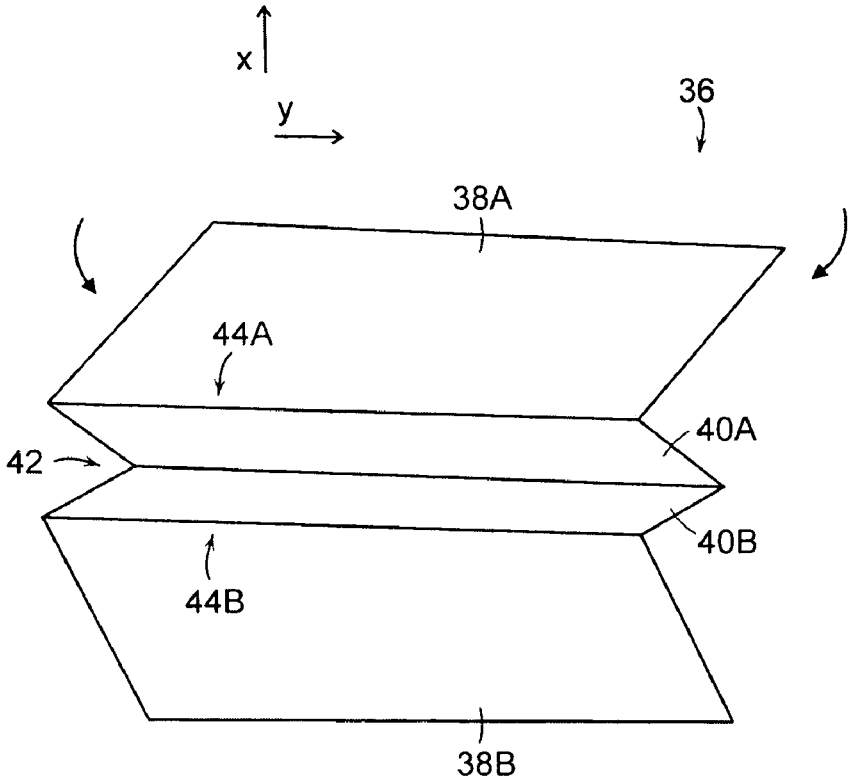
FIG. 4 schematically shows a sheet of filter material folded in an illustrative manner for the process shown in FIG. 3.

FIG. 3 shows a process of manufacturing the filter mask 10 shown in FIGS. 1 and 2. The process begins at step 300, in which a sheet of filter material 36 is folded into four sections. In particular, as shown in FIG. 4, the sheet of filter material 36 illustratively has a rectangular shape, and is folded to have two end sections 38A and 38B and two middle sections 40A and 40B. Both of the end sections 38A and 38B have a substantially equal area, while both of the middle sections 40A and 40B similarly have a substantially equal area. The area of each of the middle sections 40A and 40B, however, is smaller than that of either of the two end sections 38A and 38B.

The sheet of filter material 36 may be folded in any number of ways to obtain the configuration shown in FIG. 4. In illustrative embodiments, the sheet 36 first is folded along its longitudinal center 42 (i.e., parallel to the Y-axis shown in FIG. 4). Then, parallel second and third fold lines 44A and 44B are calculated about one inch from each side of the noted first fold. The sheet of filter material 36 then is folded along the second and third fold lines 44A and 44B to obtain the configuration shown in FIG. 4.

The filter layer 12 may be manufactured from any conventionally known filter material used for such purposes. The appropriate filter material, however, is selected based upon the intended use of the mask 10. Specifically, the filter material is selected based upon the material characteristics (i.e., porosity, rigidity, etc . . . ) required for the intended use.

For example, the filter layer 12 may be constructed from polypropylene manufactured to comply with the well known P100 NIOSH (National Institute of Safety and Health) standard. Details of the P100 NIOSH standard can be obtained from NIOSH, which has a World Wide Web site address of http://www.cdc.gov/niosh/homepage.html.

As another example, the filter layer 12 may be constructed from polypropylene manufactured to comply with the well known P3SL CE (Community European) standard. Of course, other types of materials may be used. Accordingly, discussion of specific types of materials is exemplary for many embodiments and thus, not intended to limit all embodiments of the invention. Those skilled in the art should understand which other types of materials may be used.

Figure 5:
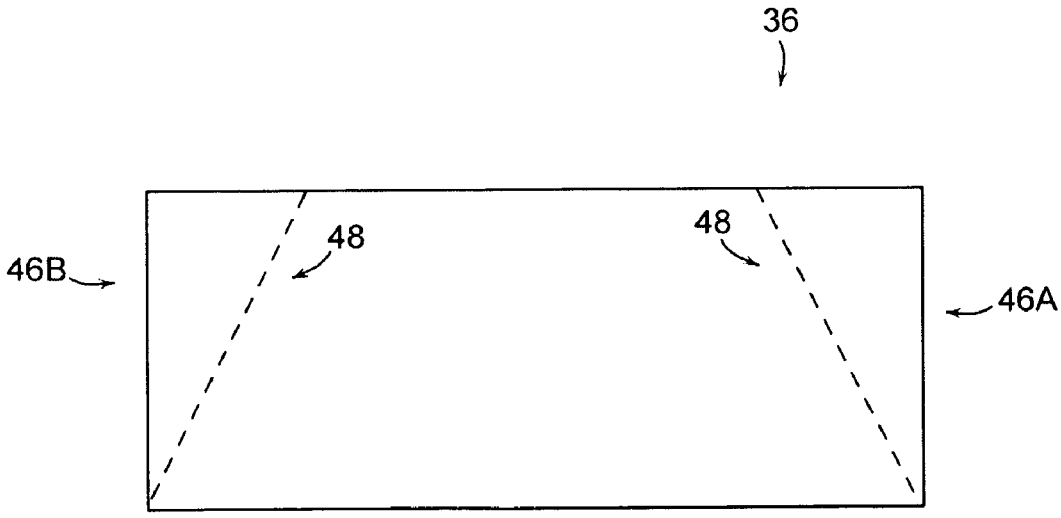
FIG. 5 schematically shows the folded filter material of FIG. 4.

After the sheet of filter material 36 is folded (step 300), the entire folded sheet is laid flat on a surface. Once flat, the process continues to step 302, in which the ends 46A and 46B of the folded sheet of filter material are reshaped. Specifically, while folded, the two ends 46A and 46B of the folded sheet are cut in a predetermined manner. In illustrative embodiments, the two ends 46A and 46B are cut along the two taper lines identified by reference number 48 in FIG. 5. The taper lines 48 illustratively converge toward the center fold, which is shown in FIG. 4. Cutting along these lines effectively reshapes the two ends of each of the end and middle sections 38A, 38B, 40A, and 40B of the folded filter sheet discussed above. In alternative embodiments, the ends 46A and 46B of the folded filter material are reshaped in a different manner, such as in a non-converging manner. For example, the ends 46A and 46B may be left in their original form.

Figure 6:
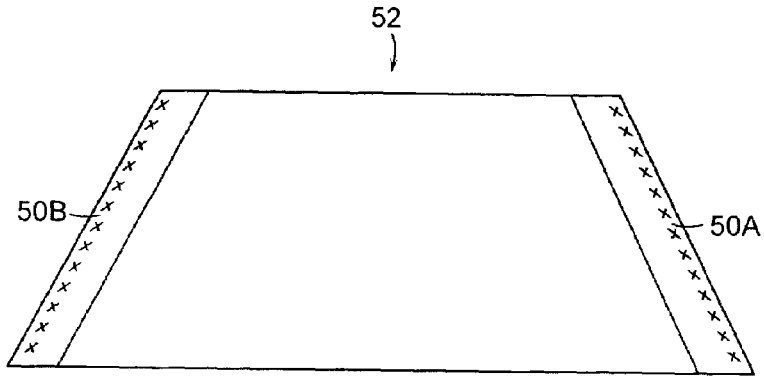
FIG. 6 schematically shows a first assembly laid flat.

After the ends are reshaped, the edges of the filter material are connected along the reshape lines as shown in FIG. 6 (step 304). Any known connecting method may be used. For example, the edges may be bonded, welded, sewn, glued, fastened, and/or heated to connect the edges. Note that, as shown in FIG. 6, the two edges of each section are not connected together. When the edges are connected, they form first and second borders 50A and 50B. At this point in the process, the filter material is considered to be a "primary assembly 52," which illustratively is normally in the form of a substantially flat trapezoid (see FIG. 6).

Figure 7:
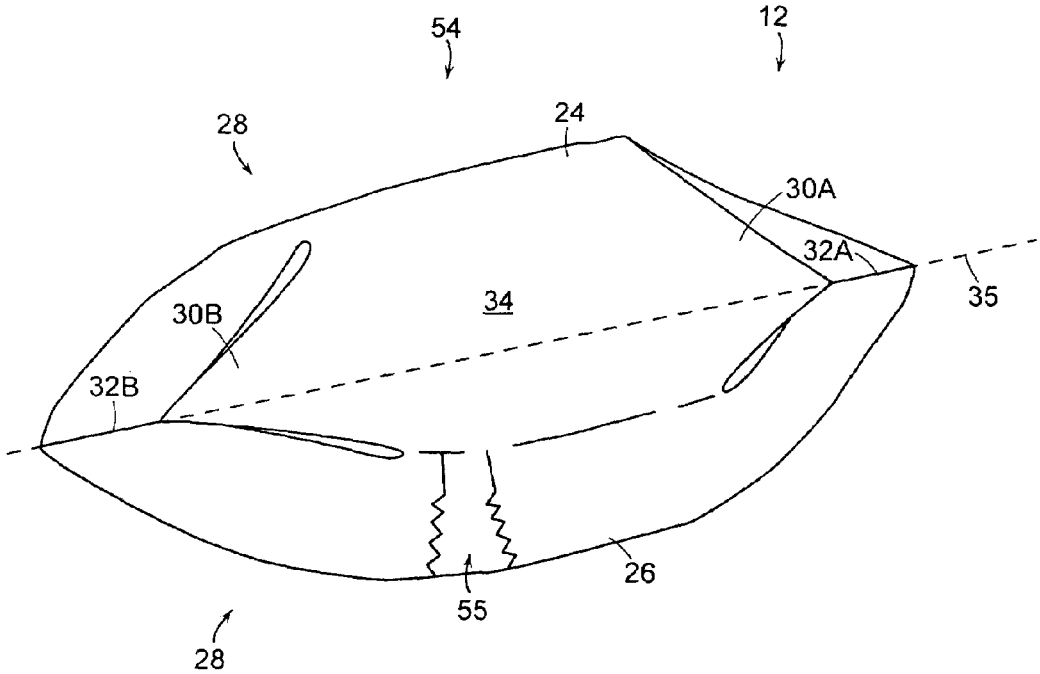
FIG. 7 schematically shows a partially cut-away second assembly produced from the first assembly shown in FIG. 6.

After the primary assembly 52 is produced, the process continues to step 306, in which the primary assembly 52 is folded inside-out to form a "secondary assembly 54," which is shown in FIG. 7 and described in detail above with regard to FIGS. 1 and 2 and referred to as the filter layer 12. Accordingly, among other things, the secondary assembly 54 includes the noted top and bottom portions 24 and 26, pleats 30A and 30B, seams 32A and 32B, and central portion 34. In addition, the secondary assembly 54 is normally open.

Figure 8A:
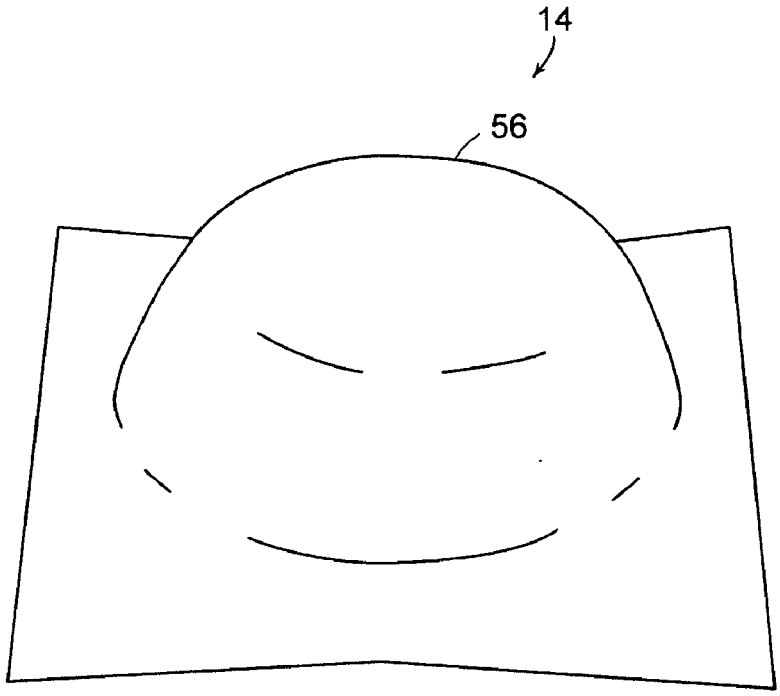
FIG. 8A schematically shows a plan view of a support base used in illustrative embodiments of the invention.
Figure 8B:
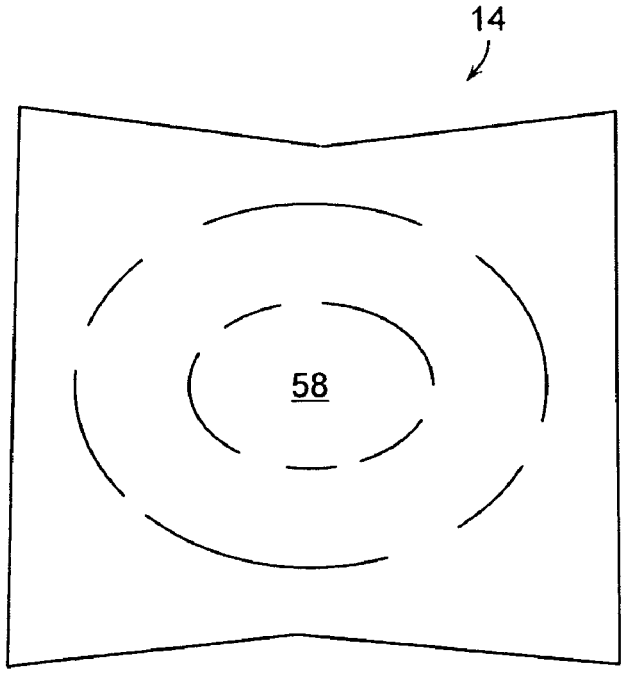
FIG. 8B schematically shows a bottom view of the support base shown in FIG. 8A.

The process then continues to step 308, in which the secondary assembly 54 is coupled with the support base 14. To that end, the secondary assembly 54 has a concave portion 55 that is placed over a convex portion 56 of the support base 14. FIG. 8A schematically shows a perspective top view of the support base 14 and its convex portion 56, while FIG. 8B schematically shows a bottom view of the support base 14 (i.e., a concave portion 58 formed by the convex portion). In some embodiments, the inner surface of the concave portion 55 of the secondary assembly 54 is substantially flush against the outer surface of the convex portion 56 of the support base 14.

The secondary assembly 54 may be coupled with the support base 14 in a number of ways. In some embodiments, the filter layer rim 28 of the secondary assembly 54 is welded to a corresponding area of the support base 14. It should be noted that in a manner similar to the reshape lines (discussed above with regard to FIG. 304), any manner known in the art for coupling the support base 14 to the secondary assembly 54 should suffice. Other than at the valve, no other portions of the secondary assembly 54 (in this embodiment) are coupled with the support base 14. Accordingly, this permits the secondary assembly 54 to move relative to the support base 14. Such movement may be caused by normal breathing.

The support base 14 illustratively is manufactured from a porous polyester that more resilient than the filter material. In other embodiments, this relative resilience is not necessary. The support base 14 material illustratively introduces no more than a negligible air resistance to the overall filter mask 10.

Figure 9:
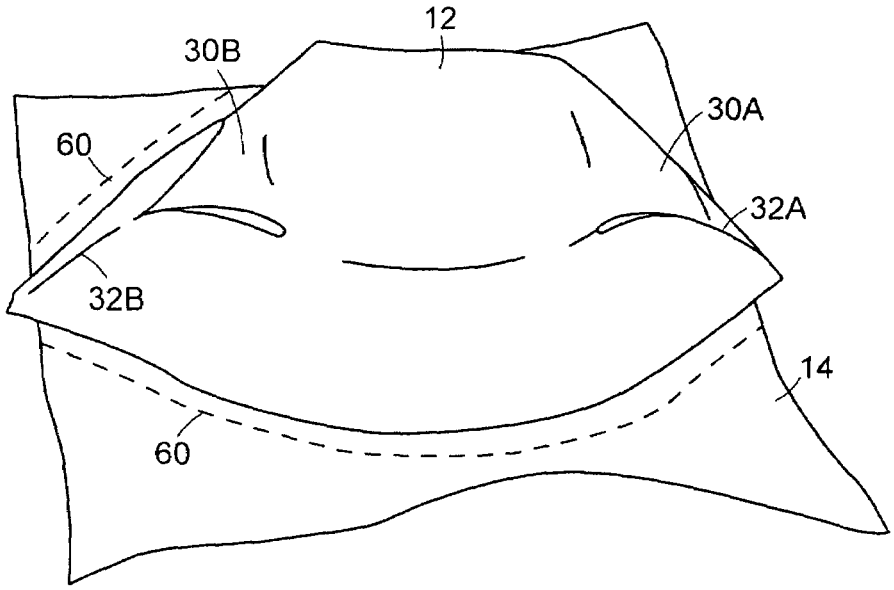
FIG. 9 schematically shows the second assembly of FIG. 7 after it is coupled with the support base of FIGS. 8A and 8B.

The process then continues to step 310, in which the final manufacturing steps are completed. In particular, excess material is removed from the support base 14 along the line identified by reference number 60 in FIG. 9. In illustrative embodiments, about ⅛ of an inch of base material extends beyond the area that connects the secondary assembly 54 to the support base 14. This extra material and the connection area together form the above noted rim 20, which has a surface that is flexible enough to contour to a user's face. In addition to removing excess material, the straps 18, nose piece 16, and valve 22 may be added, thus completing the process.

When in use, as shown in FIG. 2, the mask 10 is placed over a person's nose and mouth. The straps 18 may tie together behind the person's head, thus providing the necessary force to both hold the mask 10 to the person's face and contour the rim 20 to such person's face. The person may breath normally and without stress (caused by the mask 10). When not in use, the rim 20 is normally open and thus, ready to be easily positioned on a person's face. Manufacturing is simplified because, among other reasons, the cutting/connecting steps of the filter layer 12 (i.e., those discussed above with regard to steps 302 and 304) may be performed while the mask 10 is flat.

Although various exemplary embodiments of the invention have been disclosed, it should be apparent to those skilled in the art that various changes and modifications can be made that will achieve some of the advantages of the invention without departing from the true scope of the invention. These and other obvious modifications are intended to be covered by the appended claims.

What is claimed is:

1. A mask comprising:

a filter layer; and a support base supporting the filter layer, the filter layer having first and second complimentary portions that form a rim, the first portion being connected to the second portion at first and second seams, the first seam extending from the rim to a first pleat, the second seam extending from the rim to a second pleat, the first pleat being connected to the second pleat by an unpleated central portion, the first pleat, second pleat and unpleated central portion being formed by the first and second portions.

2. The mask as defined by claim 1 wherein the filter layer has an effective center line that bisects the filter layer in a longitudinal direction, the first and second seams being substantially coincident with the effective center line.

3. The mask as defined by claim 1 wherein the filter layer has an effective center line that bisects the filter layer in a longitudinal direction, the first and second pleats being substantially bisected by the effective center line.

4. The mask as defined by claim 1 wherein the filter layer forms a concave inner surface and the support base forms a convex outer surface, the concave inner surface of the filter layer facing the convex outer surface of the support base, the concave inner surface of the filter layer being free to move relative to the convex outer surface of the support base.

5. The mask as defined by claim 1 wherein the filter layer forms a filter rim and the support base forms a base rim, the filter rim being secured to the base rim.

6. The mask as defined by claim 1 wherein the filter layer normally is substantially free of overlap.

7. The mask as defined by claim 1 further comprising a valve extending through the filter layer and the support base.

8. The mask as defined by claim 1 wherein the support base comprises porous polyester and the filter layer comprises polypropylene.

9. The mask as defined by claim 1 wherein the support base has a surface area, the filter layer also having a surface area, the surface area of the filter layer being greater than the surface area of the support base.

10. The mask as defined by claim 1 wherein the filter layer normally forms an opening.

11. A mask comprising:

means for filtering air; and means for supporting the filtering means, the filtering means having first and second portions that form a rim, the first portion being connected to the second portion at first and second boundary means, the first boundary means extending from the rim to a first means for pleating the filtering means, the second boundary means extending from the rim to a second means for pleating the filtering means, the first pleating means and the second pleating means being connected by an unpleated central portion, the first pleating means, second pleating means, and unpleated central portion being formed by the first and second portions.

12. The mask as defined by claim 11 wherein the filtering means has an effective center that bisects the filtering means in a longitudinal direction, the first and second boundary means being substantially coincident with the effective center line.

13. The mask as defined by claim 12 wherein the first and second pleating means are substantially bisected by the effective center line.

14. The mask as defined by claim 13 wherein the filtering means normally is substantially free of overlap.

* * * * *